US009243352B2

(12) United States Patent
Griesshammer et al.

(10) Patent No.: US 9,243,352 B2
(45) Date of Patent: Jan. 26, 2016

(54) SPINNING NOZZLE AND SPINNING STATION OF AN AIR-JET SPINNING MACHINE FITTED THEREWITH

(71) Applicant: Maschinenfabrik Rieter AG, Winterthur (CH)

(72) Inventors: Christian Griesshammer, Winterthur (CH); Petr Haska, Ceska Trebova (CZ); Dorothee Betz, Pfullingen (DE); Simon Küppers, Stuttgart (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 14/303,960

(22) Filed: Jun. 13, 2014

(65) Prior Publication Data

US 2014/0366503 A1 Dec. 18, 2014

(51) Int. Cl.

| | |
|---|---|
| ***D01H 4/02*** | (2006.01) |
| ***D01H 1/115*** | (2006.01) |
| ***D01H 7/92*** | (2006.01) |

(52) U.S. Cl.

CPC ..... *D01H 4/02* (2013.01); *D01H 1/115* (2013.01); *D01H 7/92* (2013.01)

(58) Field of Classification Search

CPC ..... D01H 1/115; D01H 4/02

See application file for complete search history.

(56) References Cited

U.S. PATENT DOCUMENTS

| | | | | |
|---|---|---|---|---|
| 3,110,950 | A * | 11/1963 | Yamamoto | 28/273 |
| 3,577,720 | A * | 5/1971 | Zax et al. | 57/403 |
| 4,807,431 | A | 2/1989 | Braxmeier | |
| 5,159,806 | A | 11/1992 | Mori et al. | |
| 2002/0152739 | A1 | 10/2002 | Anderegg | |
| 2007/0022729 | A1 * | 2/2007 | Weide | 57/350 |
| 2012/0110973 | A1 * | 5/2012 | Haska et al. | 57/403 |

FOREIGN PATENT DOCUMENTS

DE 42 01 573 A1 7/1993

OTHER PUBLICATIONS

Swiss Patent Office Search Report, Sep. 26, 2013.

* cited by examiner

*Primary Examiner* — Shaun R Hurley
(74) *Attorney, Agent, or Firm* — Dority & Manning, P.A.

(57) ABSTRACT

A spinning nozzle for an air-jet spinning machine has a base body with an internal turbulence chamber, an inlet opening for the fiber sliver which enters the turbulence chamber and a fiber guide channel for guiding the fiber sliver entering the inlet opening. A thread-forming element extends at least partially into the turbulence chamber and has an inlet mouth as well as an adjoining take-off channel for the thread in the transport direction. Air nozzles are directed into the turbulence chamber. The spinning nozzle has an extension piece that is releasably fixed to the base body in the region of the inlet opening, wherein the fiber guide channel adjoining the inlet opening is formed at least partially by a channel section of the extension piece.

15 Claims, 11 Drawing Sheets

SPINNING NOZZLE AND SPINNING STATION OF AN AIR-JET SPINNING MACHINE FITTED THEREWITH

FIELD OF THE INVENTION

The present invention relates to a spinning nozzle for an air-jet spinning machine that is used for producing a thread from a fiber sliver, wherein the spinning nozzle has a base body with an internal turbulence chamber. The spinning nozzle has an inlet opening for the fiber sliver that enters the turbulence chamber in a transport direction when the air-jet spinning machine is operating. A fiber guide channel for guiding the fiber sliver entering the inlet opening is provided between the inlet opening and the turbulence chamber, wherein the spinning nozzle has a thread-forming element which extends at least partially into the turbulence chamber and has an inlet mouth as well as an adjoining take-off channel for the thread in the transport direction. The spinning nozzle has air nozzles directed into the turbulence chamber and which open out into the turbulence chamber in the region of a wall that encompasses the turbulence chamber. A spinning station of an air-jet spinning machine is also proposed.

BACKGROUND

Air-jet spinning machines with appropriately equipped spinning nozzles or spinning stations are known in the prior art (see for example DE 40 36 119 C2) and are used to produce a thread from an elongated fiber sliver. Here, the outer fibers of the fiber sliver are wound around the inner core fibers with the help of a turbulent air flow produced inside the turbulence chamber by means of the air nozzles in the region of the inlet mouth of the thread-forming element and finally form the entwined fibers that are crucial for the required strength of the thread. This results in a thread with a genuine twist that can ultimately be guided out of the turbulence chamber via the take-off channel and wound onto a spool, for example.

In general, within the meaning of the invention, the term thread is therefore understood to mean a fiber sliver with which at least some of the fibers are wound around an inner core. This therefore includes a thread in the conventional sense that can be processed into a material, for example with the help of a web machine. However, the invention also relates to air-jet spinning machines, with the help of which so-called slubbing or roving can be produced. This type of thread is characterized in that, in spite of a certain strength which is sufficient to transport the thread to a downstream textile machine, is still capable of being distorted. The roving can therefore be distorted with the help of a distortion device, e.g. the stretching unit, of a textile machine that processes the roving, for example a ring spinning machine, before it is finally spun.

However, regardless of the strength of the thread, it is always desirable that the twist that is produced in the region of the thread-forming element does not propagate outwards beyond the inlet opening in the opposite direction to the transport direction of the thread or fiber sliver. In other words, it must therefore be ensured that the fibers of the fiber sliver retain their original alignment before coming into contact with the turbulent air flow and only sustain the appropriate twist inside the turbulence chamber. If the twist were to propagate namely in the opposite direction to the transport direction, then the reverse rotation of the fiber sliver would thereby necessarily lead to a reduction in the required entwined fibers and to a reduced ability of the fiber sliver to deform in the region of a deformation unit located before the turbulence chamber.

While a pin pointing in the direction of the thread-forming element is proposed in the above-mentioned publication in order to prevent the said propagation, it is also known to realize the inlet opening of the turbulence chamber by an opening of the so-called fiber guide element, wherein the opening is positioned with a lateral offset with respect to the inlet mouth of the thread-forming element. This results in a shoulder that the fiber sliver must pass before the thread is actually produced, wherein, as a result of the friction between fiber sliver and fiber guide element, the rotation of the fiber sliver is prevented from being able to propagate in the opposite direction to the transport direction.

As with the known solutions, the guide channel is always formed by the fiber guide element that is securely attached to the base body of the spinning nozzle, the spinning nozzle can usually only be used for a certain type of fiber sliver or fibers with a certain length, as the distance between fiber guide element and a delivery roller pair located before the spinning nozzle must usually be matched to a certain fiber length.

SUMMARY

An object of the present invention is to propose a spinning nozzle and a spinning station of an air-jet spinning machine fitted therewith which overcomes this disadvantage. Additional objects and advantages of the invention will be set forth in part in the following description, or may be obvious from the description, or may be learned through practice of the invention.

The objects are achieved by a spinning nozzle and a spinning station with the characteristics described and claimed herein.

With regard to the spinning nozzle according to the invention, it is proposed that the spinning nozzle has an extension piece that is releasably fixed to the base body in the region of the inlet opening, wherein the fiber guide channel adjoining the inlet opening is formed at least partially by a channel section of the extension piece. In other words, it is therefore provided that the fiber guide channel is at least not exclusively formed by a fiber guide element that is rigidly attached to the base body. Rather, an extension piece that can easily be changed depending on the type or length of the fibers to be processed, is provided. Depending on the geometry, and in particular the length, of the extension piece, this ultimately results in a fiber guide channel with a length or shape that is appropriately matched to the fiber sliver. As a result, widely differing types of fiber or fibers with widely differing staple lengths can be processed with one and the same spinning nozzle without having to undertake elaborate adjustments to the spinning nozzle for this purpose. If, for example, a particularly long fiber guide channel is required, then an extension piece with a correspondingly long guide channel (section) is used. If the distance between the spinning nozzle and the upstream delivery rollers is increased, then the distance between the spinning nozzle (or its extension piece) and the delivery rollers, which is crucial for the correct guidance of the fiber sliver, can be kept approximately constant or set to a required value by the correct choice of extension piece. Preferably, the extension piece has a base body with an aperture designed as a fiber guide channel (section), for example in the form of a hole, that can extend from a side facing away from the base body of the spinning nozzle towards a side facing the spinning nozzle.

It is particularly advantageous when the extension piece is attached to the base body of the spinning nozzle by means of one or more magnets. This creates a connection between the base body of the spinning nozzle and the extension piece that can be quickly made or released but is still secure. Here, the magnets can either be fixed to the base body or to the extension piece, wherein magnets can also be provided on both components. The connection can of course also be made with the help of plug-in, clip, or screw connections without deviating from the concept of the invention.

It is also advantageous when the base body likewise has a channel section that adjoins the channel section of the extension piece viewed in the transport direction and forms the fiber guide channel jointly therewith. As a result, in this case, the channel section of the base body forms an end section of the fiber guide channel (viewed in the transport direction of the fiber sliver) which is either formed as an aperture of the base body or can be formed by a separate fiber guide element that is preferably rigidly attached to the base body.

Further, it is of advantage when the extension piece rests, at least in sections, on the base body in an interlocking manner. For example, the extension piece can have a surface facing the base body that is curved concavely with respect to the base body (wherein, in this case, the base body should have a correspondingly convex-shaped mating surface with which the extension piece comes into contact). It is also conceivable that the extension piece has a contact surface for the interlocking contact with the base body that is designed in the form of a channel and, for example, has three flat surface sections that in each case merge with one another at an obtuse angle. In this case, it would again be of advantage when the base body has a wedge-shaped surface section (possibly with flattened tip) that preferably rests flat on the contact surface of the extension piece. In this case, it should be ensured by the choice of the touching surfaces of the base body and of the extension piece that a relative movement between extension piece and base body is prevented in as many spatial directions as possible. In addition or alternatively, it can likewise be of advantage when there is a frictional connection between the extension piece and the base body that counteracts a movement of the extension piece relative to the base body at least in the direction of one spatial axis. This can also prevent accidental slipping of the extension piece relative to the base body so that the extension piece, which is fixed by means of magnets, for example, always remains in its intended position.

It is likewise advantageous when the extension piece comprises a base element and an insert connected to the base element. In this way, it is possible to produce the insert, which forms or encompasses the guide channel or at least part thereof, from a particularly wear-resistant material. The insert can be attached releasably or also securely (e.g. by gluing) to the base element. In addition, the insert is preferably located in an appropriate mounting depression, for example a hole, of the base element, wherein any magnets which may be present are advantageously attached to the base element.

It is also advantageous when the insert is in contact with a fiber guide element of the base body of the spinning nozzle, wherein the insert and the fiber guide element jointly border the fiber guide channel at least in part. In this case, the fiber guide element forms a base section of the fiber guide channel that opens out into the turbulence chamber. Ultimately, the extension piece is attached to the fiber guide element, advantageously in the opposite direction to the transport direction, and together with the latter forms the fiber guide channel, the length and geometry of which can ultimately be varied depending on the fiber sliver by the choice of the particular extension piece.

It is likewise advantageous when the extension piece has at least one concave surface section extending perpendicular to the transport direction. If this surface section is ultimately arranged adjacent to a first (preferably driven) roller of the delivery roller pair (e.g. of a stretching unit) arranged before the spinning nozzle, then this results in a gap between the extension piece and the roller. This gap can ultimately be chosen to be as small as possible in order to prevent unfavorable air flows in the region of the inlet opening of the spinning nozzle. In particular, it is of advantage in this case when the surface section runs concentrically with respect to the sleeve surface of the first roller.

Further, it is of advantage when the concave surface section is designed to follow the contour of a cylindrical sleeve, as the already mentioned delivery roller pair is usually arranged directly before the spinning nozzle (in the transport direction). If one roller of the delivery roller pair is now positioned as close as possible to the extension piece, then a gap, which when viewed in cross section, is in the shape of a section of a ring, is produced, the advantages of which will be discussed in more detail in the following description.

In particular, it is extremely advantageous when the insert has a length L1 extending in the transport direction, the magnitude of which lies between 1 mm and 100 mm, preferably between 2 mm and 50 mm, particularly preferably between 4 mm and 25 mm. If the length lies in one of the ranges mentioned, then the spinning nozzle can be used for processing a multiplicity of fiber slivers (i.e. fibers of widely differing staple lengths) by choosing an appropriate extension piece.

It is advantageous when the fiber guide channel has a length L2 extending in the transport direction (of the fiber sliver), the magnitude of which lies between 6 mm and 110 mm, preferably between 7 mm and 60 mm, particularly preferably between 9 mm and 30 mm. This enables a majority of the industrially processable fiber slivers to be guided, wherein the guide channel can be formed either exclusively by the extension piece or jointly by the extension piece and the adjacent fiber guide element.

The spinning station according to the invention of an air-jet spinning machine is ultimately distinguished in that it comprises a spinning nozzle according to the previous description and a delivery roller pair arranged before the spinning nozzle in the transport direction. The delivery roller pair can, for example, be part of a stretching unit arranged before the spinning nozzle that homogenizes the incoming fiber sliver by stretching it when the spinning station is in operation. In addition, the spinning station can have a take-off device for the produced thread (e.g. a take-off roller pair) arranged after the spinning nozzle in the transport direction, and a winding apparatus for coiling up the thread.

It is advantageous when the extension piece has at least one concave surface section extending perpendicular to the transport direction, wherein the concave surface section runs adjacent to a sleeve surface of a first roller of the delivery roller pair. In this case, the said surface section can nestle as close as possible against the first roller, thus enabling the gap between first roller and extension piece to be minimized. A gap of this kind has the effect that the drag air flow (i.e. the air flow which occurs in the vicinity of the surface of the roller due to the rotation thereof) produced by the first roller (that is preferably a driven roller, which, for example, can have a rough or fluted surface) is as small as possible. In this way, it is ultimately ensured that the first roller does not produce any flow of air opposing the required air flow in the region of the inlet opening of the spinning nozzle. Rather, a flow of air directed into the fiber guide channel is required in the region of the inlet opening in order to suck the fiber sliver, and in particular short or protruding fibers, into the turbulence chamber (wherein the necessary vacuum in the region of the inlet opening is produced by the air flow generated by the air nozzles of the spinning nozzle due to the Venturi effect).

Further, it is of advantage when the concave surface section and the sleeve surface of the first roller run concentrically. This results in a gap with a particularly large surface area between the first roller and the surface section, thus enabling a drag air flow of the first roller to be "peeled off" to a certain extent by the extension piece.

Furthermore, it is advantageous when the concave surface section has a width B1 in a direction running perpendicular to the transport direction, that the sleeve surface of the first roller adjacent to the concave surface section has a width B2, and that the ratio between B1 and B2 has a value, the magnitude of which lies between 0.2 and 5, preferably between 0.5 and 2, particularly preferably between 0.8 and 1.25. In other words, it is of advantage when the ratio is close to 1. In this case, B1 is approximately equal to B2 so that the whole roller is covered by the extension piece over a certain circumferential range.

Likewise it is advantageous when the extension piece has a second surface section adjacent to the concave surface section, wherein the second surface section runs adjacent to a sleeve surface of a second roller of the delivery roller pair. In a side view (i.e. looking at the face sides of the rollers) the extension piece has a contour that tapers towards the delivery roller pair (wherein the tip area can also be flattened) and therefore has a roof-shaped surface.

In addition, it can be advantageous when the second surface section is at least largely flat. In this case, there is a gap between the second roller and extension piece that differs from the ring-section-shaped gap (viewed in cross section) between the first roller and extension piece. As a result, this prevents the occurrence of an air flow that is directed outwards from the inlet opening of the spinning nozzle in the direction of rotation of the second roller. An air flow of this kind would compete with the air flow which is directed into the turbulence chamber and negatively affect the required flow conditions in this area.

It is particularly advantageous when the normal of the flat region of the second surface section encloses an angle $\alpha$ with a longitudinal axis of the fiber guide channel that extends in the transport direction, the magnitude of which lies between 0° and 60°, preferably between 25° and 55°, particularly preferably between 30° and 50°. In other words, it is of advantage when the normal of the second surface section is aligned approximately in the direction of the axis of rotation of the second roller. In a side view of the spinning nozzle (looking at the face sides of the first and second roller), this ultimately results in a substantially triangular intermediate space that can extend over the width of the two rollers. As a result of the vacuum in the region of the inlet opening (which is maintained by the vacuum within the turbulence chamber and the described drag air flow of the first roller), there is ultimately an air flow directed from both sides (i.e. from the face sides of the two rollers) in the direction of the inlet opening. This ultimately causes a compression of the fiber sliver before it enters the turbulence chamber so that even fiber ends protruding from the fiber sliver are pressed closely against the fiber core.

It is also extremely advantageous when, in each case, a gap is present between the first roller and the concave surface section and the second roller and the second surface section, wherein the distance A1 between the first roller and the concave surface section is less than the distance A2 between the second roller and the second surface section. In this case, no or only very little vacuum is produced in the region of the inlet opening of the spinning nozzle by any drag air flow that may be produced by the second roller (which, however, usually has a smooth surface). In contrast with this, it is usually required for the first roller to produce a vacuum in order to accelerate the air flow that runs parallel to the axes of rotation of the rollers of the delivery roller pair and ultimately flows into the inlet opening of the spinning nozzle, as this effects the compression of the fiber sliver.

Furthermore, it is advantageous when the distance A1 has a magnitude that lies between 0.1 mm and 5 mm, preferably between 0.1 mm and 3 mm, particularly preferably between 0.2 mm and 2 mm. This results in the described narrow gap between extension piece and first roller which, in a side view of the spinning nozzle (viewed on the face sides of the rollers), can, for example, extend over a length which preferably corresponds to 1/10 to 1/4 of the circumference of the first roller.

Likewise, it can be of advantage when the distance A2 has a magnitude that lies between 0.5 mm and 10 mm, preferably between 1 mm and 8 mm, particularly preferably between 2 mm and 6 mm. If the distance lies within the stated ranges, a negative influencing of the air flow prevailing in the region of the inlet opening due to the rotation of the second roller is virtually ruled out or at least minimized.

It is also of advantage when the concave surface section and the second surface section are joined to one another by an intermediate surface. Here, the intermediate surface has a width B3 running perpendicular to the transport direction, wherein the ratio between B2 and B3 preferably has a value, the magnitude of which lies between 0.2 and 5, preferably between 0.5 and 2, particularly preferably between 0.8 and 1.25. In addition or alternatively, it can ultimately be advantageous when the intermediate surface has a height H running perpendicular to the transport direction and perpendicular to the width B3, the magnitude of which lies between 0 mm and 12 mm, preferably between 0 mm and 8 mm, particularly preferably between 0 mm and 6 mm, wherein a height H of 0 mm means that the extension piece tapers to a point and the concave surface section merges directly with the second surface section). As a result of the stated values, it is ultimately ensured that the two rollers of the delivery roller pair together with the extension piece form a channel which preferably extends over the whole width of the extension piece and of the rollers and which has a substantially triangular form in a side view.

BRIEF DESCRIPTION OF THE DRAWINGS

Further advantages of the invention are described in the following exemplary embodiments. In the drawing.

DETAILED DESCRIPTION

Figure 1:
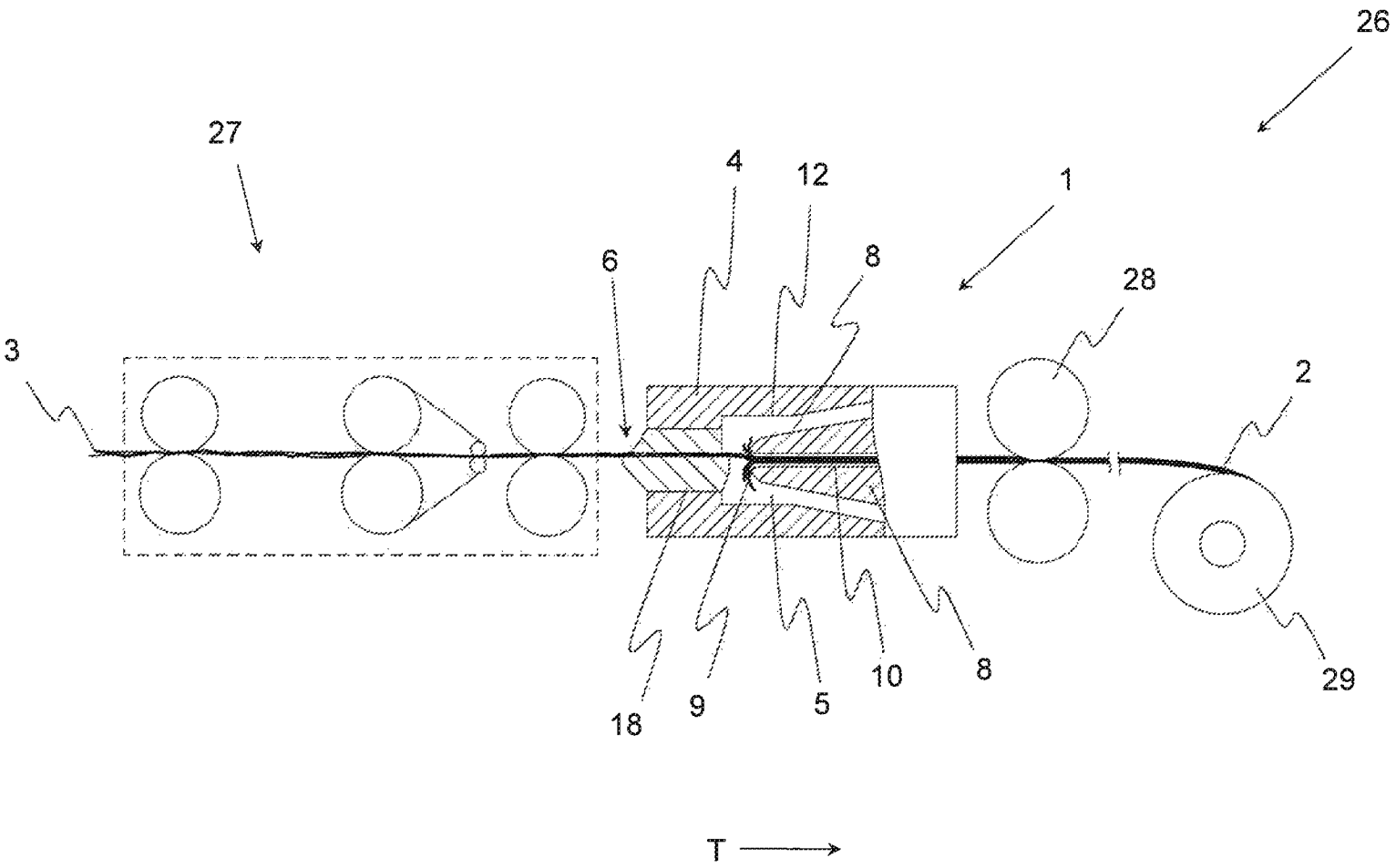
Fig. 1 Prior Art
FIG. 1 shows a side view of a known spinning station.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

First, it is expressly pointed out that the depicted sections of various spinning stations and the elements arranged upstream and downstream in FIG. 1 are not drawn to scale. Rather, the individual figures only show schematic diagrams intended to clarify the design in principle of the respective assemblies. In particular, the distances and angles respectively identified in part in the figures have values that do not necessarily reflect the most advantageous ranges.

Further, it is pointed out at this juncture that the characteristics described in the following can basically be realized in different kinds of air-jet spinning machines. For example, air-jet spinning machines used to produce a "finished" thread 2, which can be woven, knitted or otherwise directly processed in a further step, are known. Likewise, the air-jet spinning machine according to the invention can be used to produce a so-called slubbing or roving that has to be provided with an additional twist, for example with the help of a ring spinning machine, before final processing. Within the framework of the claims and the description, the designation "thread" is therefore understood to mean a finished thread or a so-called slubbing depending on the spinning machine used.

FIG. 1 now shows a schematic view of a section of an air-jet spinning machine designed as a roving spinning machine. As required, the roving spinning machine can comprise a stretching unit 27 that is supplied with a fiber sliver 3, for example in the form of a doubled stretch sliver. Further, the roving spinning machine shown principally comprises a spinning nozzle 1 at a distance from the stretching unit 27 with an internal turbulence chamber 5 in which the fiber sliver 3, or at least some of the fibers of the fiber sliver 3, are provided with a producer twist (the exact principle of operation of the spinning nozzle 1 will be described in more detail below).

Likewise, the roving spinning machine can comprise a take-off roller pair 28 and a winding apparatus 29 (likewise shown schematically) for the produced thread 2 downstream of the take-off roller pair 28. The apparatus according to the invention does not necessarily have to have a stretching unit 27 as shown in the figure. Neither is the take-off roller pair 28 absolutely necessary.

The roving spinning machine now works according to a special air-jet spinning process. To form the thread 2, the fiber sliver 3 is fed in a transport direction T via an inlet opening 6 of a fiber guide element 18 (preferably designed as a separate component) into the turbulence chamber 5 of the spinning nozzle 1. Here, it is given a produced twist, i.e. at least some of the fibers of the fiber sliver 3 are gathered by an air flow that is generated by appropriately positioned air nozzle 11 (see for example FIG. 2). In doing so, some of the fibers are pulled at least slightly out of the fiber sliver 3 and wound around the tip of a thread-forming element 8 which projects into the turbulence chamber 5.

With regard to the air nozzles 11, for purely precautionary reasons it is mentioned at this point that these should normally be aligned so that an air flow is produced in the same direction with a common direction of rotation. Preferably, the individual air nozzles 11 are arranged rotationally symmetrically with respect to one another here. Further, with regard to all exemplary embodiments shown, it must be noted that the air nozzles 11 in each case have a flow direction that is aligned in the direction of a wall 12 so that the air flow generated extends at least substantially in the form of a spiral between the outer surface of the thread-forming element 8 and the wall 12 of the turbulence chamber 5.

Finally, the fibers of the fiber sliver 3 are extracted from the turbulence chamber 5 via an inlet mouth 9 of the thread-forming element 8 and a take-off channel 10 that is arranged within the thread-forming element 8 and is connected to the inlet mouth 9. Here, the free fiber ends 30 (see FIG. 2) are also ultimately drawn on a spiral path in the direction of the inlet mouth 9 and in doing so are wrapped around the centrally running core fibers as entwined fibers—resulting in a thread which has the required produced twist (and which is usually referred to as slubbing or roving).

As a result of the only partial twisting of the fibers, the thread 2 has a residual ability to distort which is indispensable for the further processing of the thread 2 in a downstream spinning machine, for example a ring spinning machine. On the other hand, conventional air-jet spinning apparatuses impart such a severe twist to the fiber sliver 3 that the required distortion following thread production is no longer possible. This is also desirable in this case, as conventional air-jet spinning machines are designed to produce a finished thread 2 which, as a rule, is to be distinguished by high strength. The invention relates both to air-jet roving spinning machines and air-jet spinning machines in the conventional sense.

Figure 2:
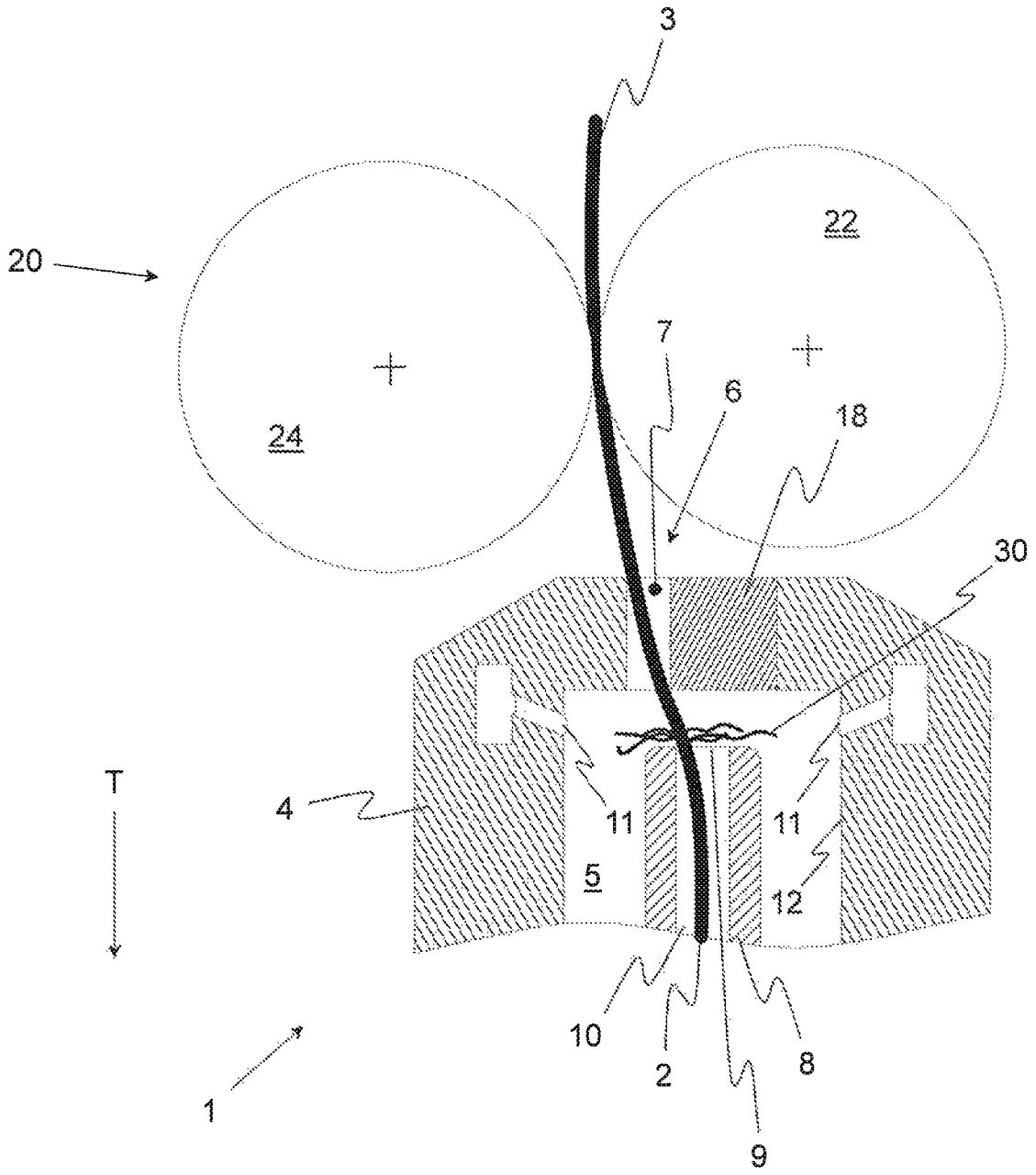
Fig. 2 Prior Art
FIG. 2 shows a partially cut-away section of a known spinning station.
Figure 3:
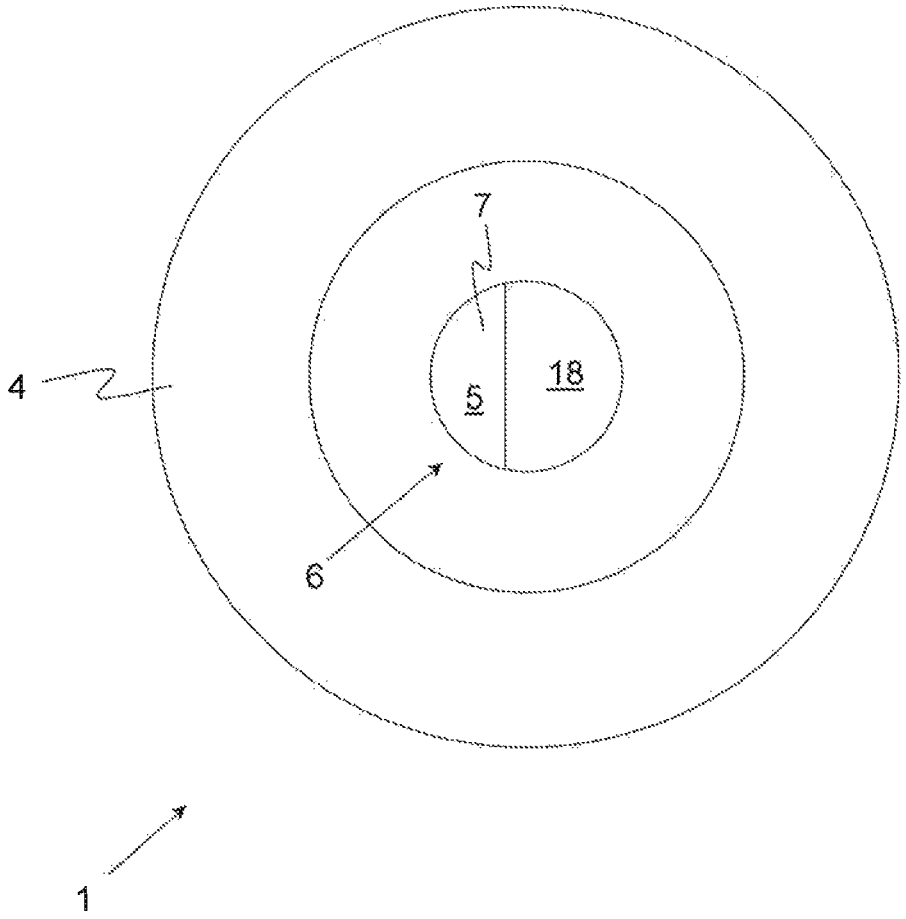
Fig. 3 Prior Art
FIG. 3 shows a plan view of the spinning nozzle shown in FIG. 2.

Further details of the spinning nozzle 1 shown in FIG. 1 can be seen from FIGS. 2 and 3 (wherein FIG. 3 is a plan view of the spinning nozzle 1 shown in FIG. 2). As a rule, this has a base body 4 that encompasses the turbulence chamber 5, wherein the turbulence chamber 5 is connected to a fiber guide channel 7 of the fiber guide element 18. The fiber guide channel 7 serves to guide the fiber sliver 3 while it is being sucked into the turbulence chamber 5 (wherein the vacuum necessary for this is produced by the air flow generated by the air nozzles 11). In addition, the position of the fiber guide channel 7, which for this purpose is not arranged in line with the take-off channel 10, prevents the produced twist propagating in the direction of the upstream delivery roller pair 20 starting from the inlet mouth 9 of the thread-forming element 8, as this would have a negative effect on the required imparting of a producer twist (or imparting of a twist in the case of a conventional air-jet spinning machine) in the region of the inlet opening 6.

While the fiber guide channel 7 disclosed in the prior art is formed exclusively by the fiber guide element 18 shown in FIG. 2, the fiber guide channel 7 according to the invention is now distinguished in that it is formed at least partially by a separate extension piece 13 (FIG. 4) that is releasably attached to the base body 4 of the spinning nozzle 1. The connection between extension piece 13 and base body 4 can be realized, for example, by a screw connection. Alternatively however, it can likewise be of advantage to provide the base body 4 or (as shown in FIG. 6) the extension piece 13 with one or more magnets 15 in order to ensure the necessary holding force between extension piece 13 and base body 4.

As a result, a solution is therefore proposed in which the length (and if necessary also the geometry) of the fiber guide channel 7, which is formed at least partially by the extension piece 13, can be easily and quickly changed by the appropriate choice of the extension piece 13. This enables the spinning nozzle 1 to be adapted elegantly to the length or type of fibers of the fiber sliver 3 to be processed without having to replace the whole spinning nozzle 1.

Figure 4:
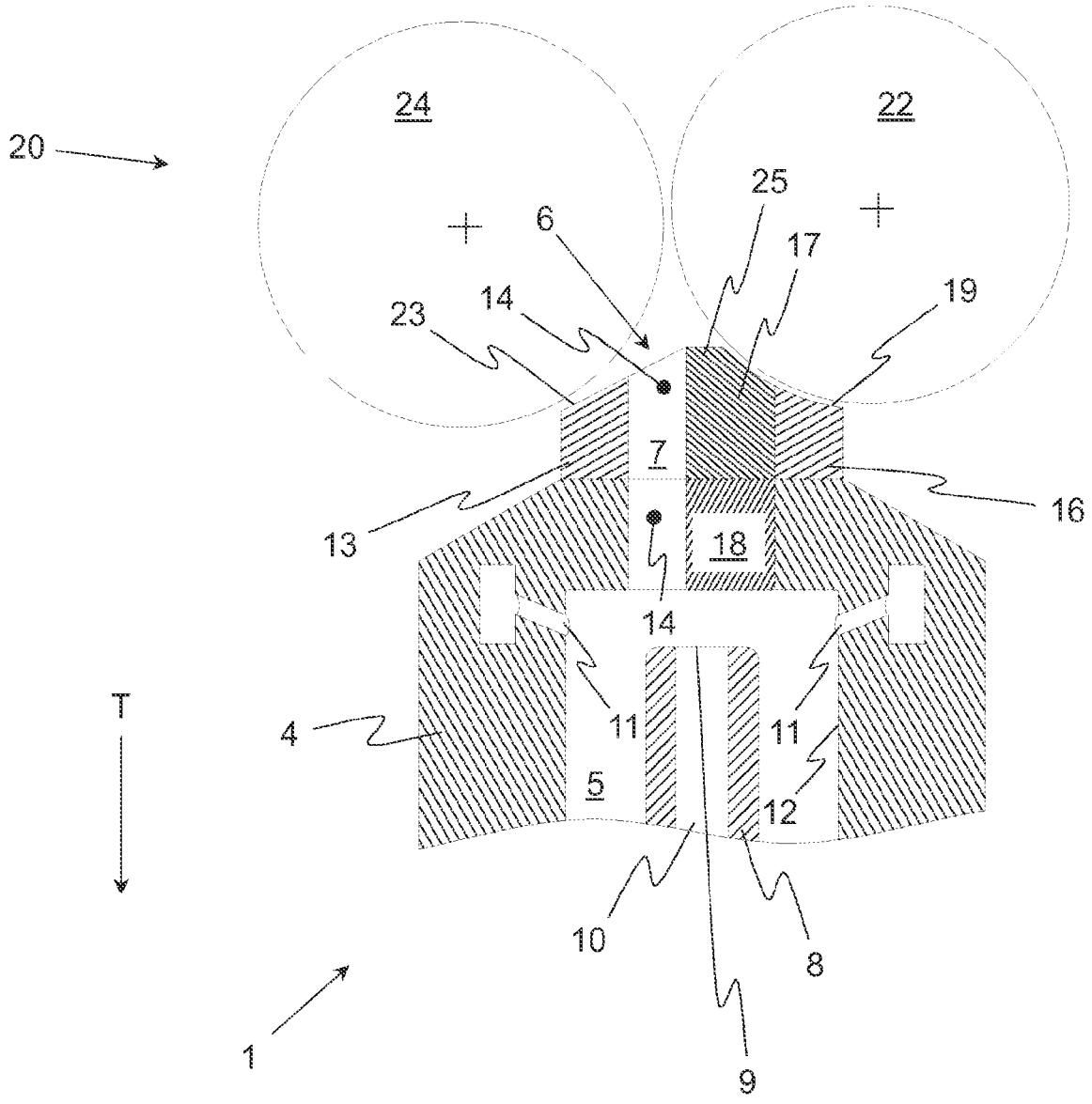
FIG. 4 shows a partially cut-away section of a spinning station according to the invention.
Figure 6:
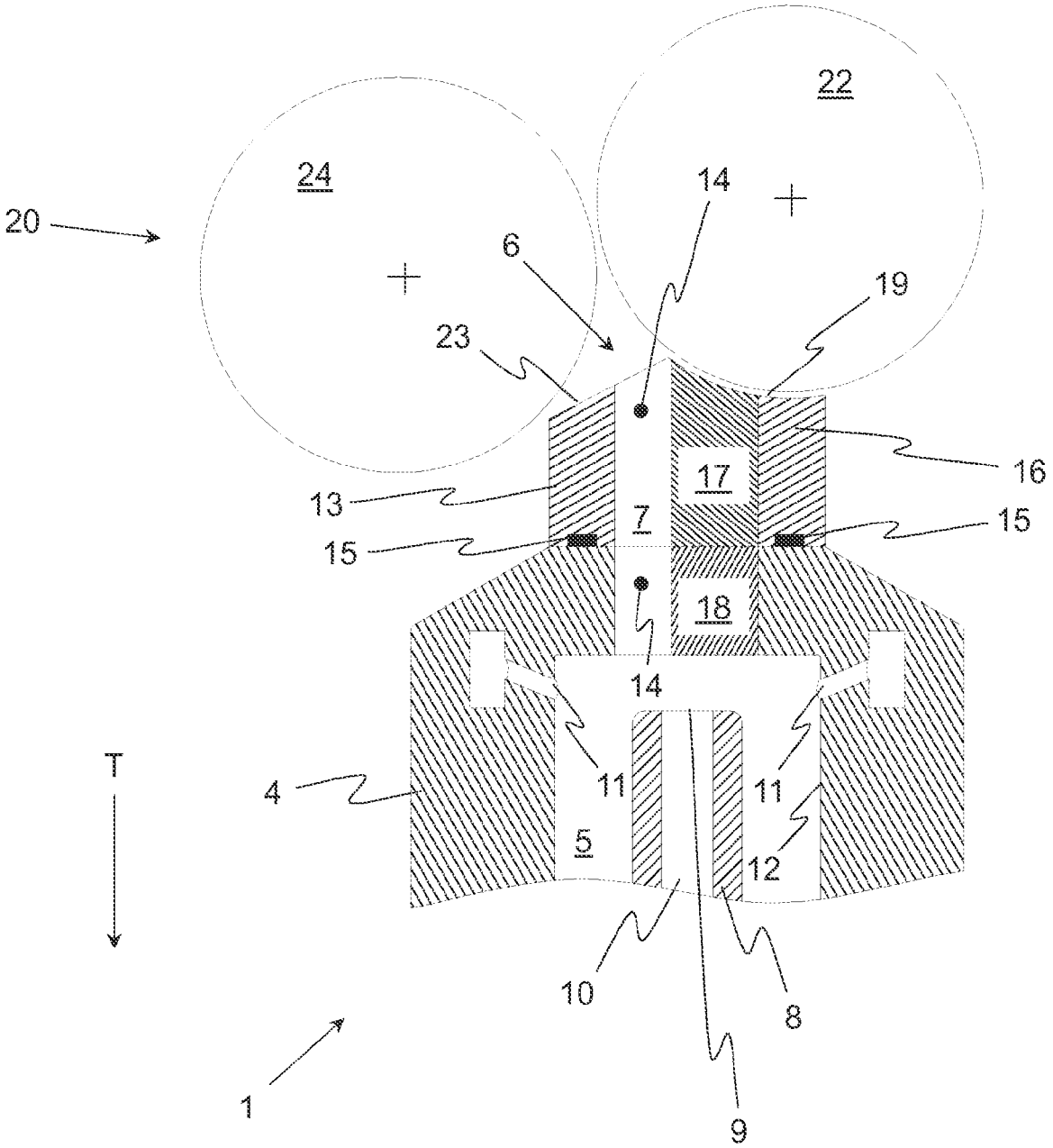
FIG. 6 shows a partially cut-away section of a further spinning station according to the invention.

A comparison of FIGS. 4 and 6 clearly shows the advantage of the solution according to the invention. While the positions of the first roller 22 and the second roller 24 of the delivery roller pair 20 differ from one another in the two figures, both in the X and in the Y-direction, it can be ensured by the suitable choice of the extension piece 13 that the distance between the said rollers and the inlet opening 6 of the spinning nozzle 1 is minimal. As a result, in both cases, it is ensured that the fiber sliver 3 can be guided in the best possible manner when transferring from the delivery roller pair 20 to the spinning nozzle 1 in order to prevent breakage of the fiber sliver 3 or unwanted distortion.

In a further embodiment, it is of advantage when the fiber guide channel 7 is formed by two channel sections 14 that preferably run colinearly, wherein a first channel section 14 runs inside the base body 4 and the fiber guide element 18 associated therewith, and a second channel section 14 runs inside the extension piece 13.

Likewise, it can be of advantage when the extension piece 13 at least consists of two individual parts which are joined to one another, namely a base element 16 and an insert 17 which forms the said channel section 14. This makes it possible, for example, to make the two individual parts from different materials, wherein it is recommended that the insert 17 be made from a particularly wear-resistant material, as this is in contact with the moving fiber sliver 3.

Figure 7:
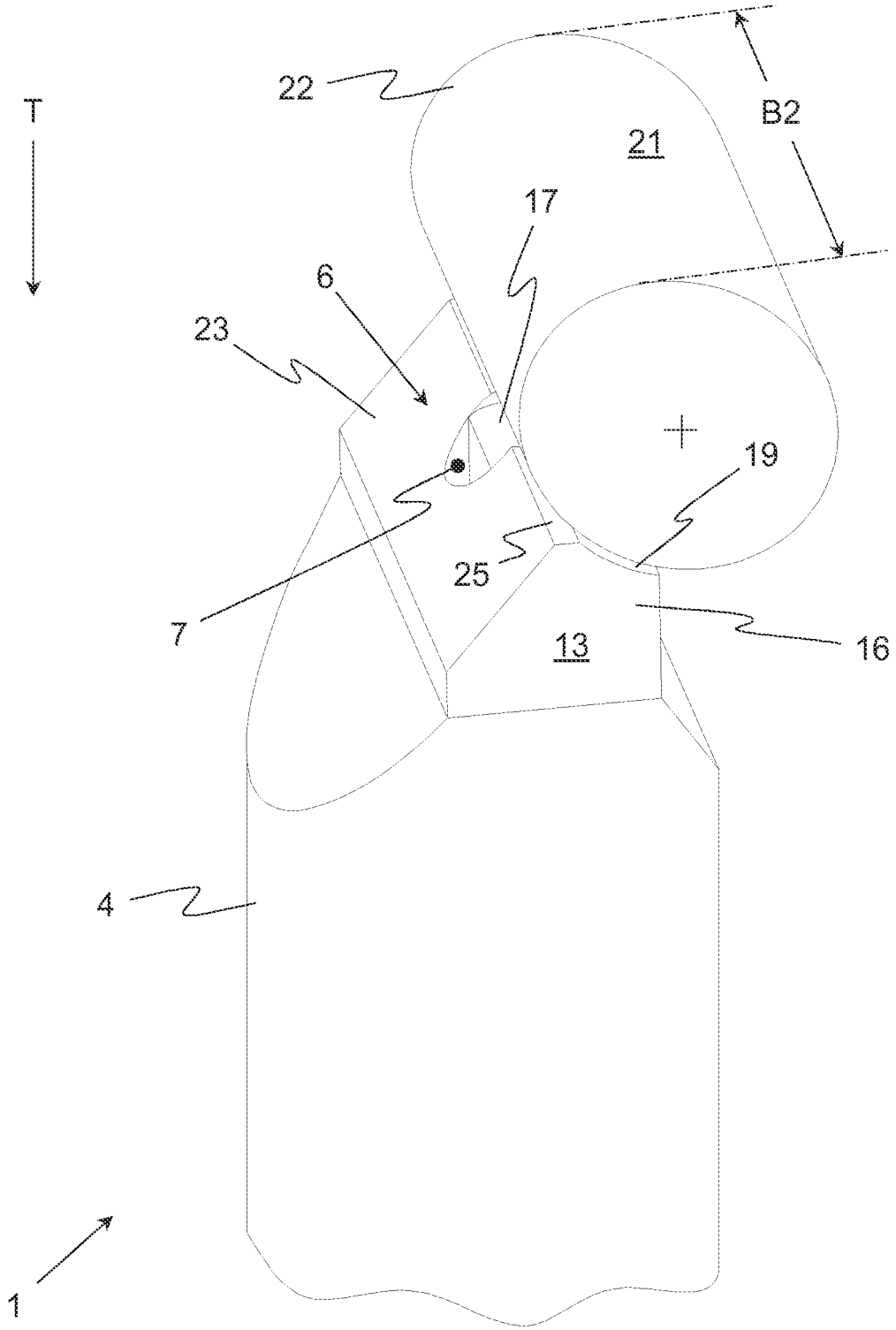
FIG. 7 shows the view according to 5 with associated first roller.
Figure 8:
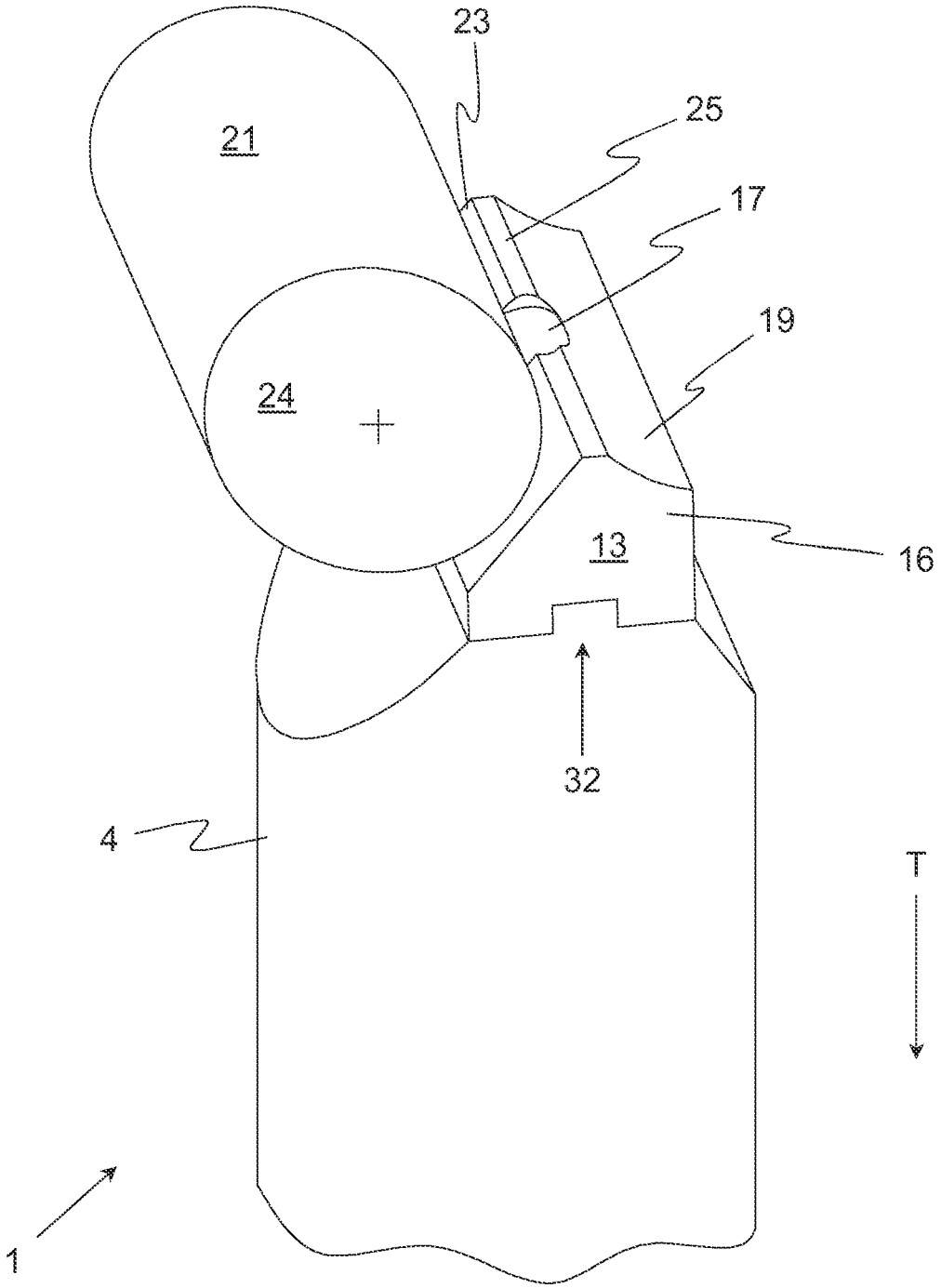
FIG. 8 shows the view according to 5 with associated second roller.

Further advantageous characteristics of the extension piece 13 can be seen in particular from FIGS. 7 and 8, wherein the same combination of spinning nozzle 1 and extension piece 13 can be seen in both figures (the two embodiments differ only by way of a positive fit in the region of the connecting surface between extension piece and base element which may have to be provided and is shown in FIG. 8, and which can ensure the correct position of the extension piece with respect to the base body, wherein the positive fit could be realized, for example by a tongue-and-groove connection 32). For reasons of clarity, the first roller 22 has been omitted solely in FIG. 7 and the second roller 24 in FIG. 8, wherein the corresponding spinning station 26 should of course include both rollers 22, 24.

In all cases, it has proved worthwhile for the extension piece 13 to have a concave surface section 19 associated with the first roller 22 and a (preferably flat) second surface section 23 associated with the second roller 24. As can be further seen from the figures, the two surface sections can also be joined by an intermediate surface 25, the surface of which can run perpendicular to the longitudinal axis of the take-off channel 10, for example (as FIG. 6 shows however, an intermediate surface 25 of this kind is not absolutely necessary so that the said surface sections 19, 23 can also merge directly into one another).

The embodiment mentioned of the two surface sections 19, 23 now has the following advantage: While the thread is being produced, as already mentioned, there is a flow of air that extends from outside the turbulence chamber 5 via the fiber guide channel 7 into the interior of the turbulence chamber 5, wherein this air flow is desirable in order to move the fiber sliver 3 in the direction of the turbulence chamber 5.

In addition, as a result of the rotational movement of the first roller 22 (the surface of which is preferably rough, e.g. fluted), there is a flow of air that extends from the inlet opening 6 of the fiber guide channel 7 in the direction of rotation of the first roller 22. This drag air flow therefore likewise generates a vacuum in the region of the inlet opening 6. The vacuum ultimately causes a flow of air that extends, for example, with reference to FIG. 4 and looking onto the plane of the drawing, from above and below the delivery roller pair 20 into the gap which is bordered by the first roller 22, the second roller 24 and the extension piece 13. This air flow ultimately causes an advantageous compression of the fiber sliver 3 in a direction from the outside towards the inlet opening 6 and in a direction perpendicular to the transport direction of the fiber sliver 3.

On the other hand, the surface of the second roller 22 should preferably be relatively smooth so that a corresponding drag air flow in this region can be minimized (an air flow of this kind would have a negative effect on the remaining air flows which are formed).

Figure 5:
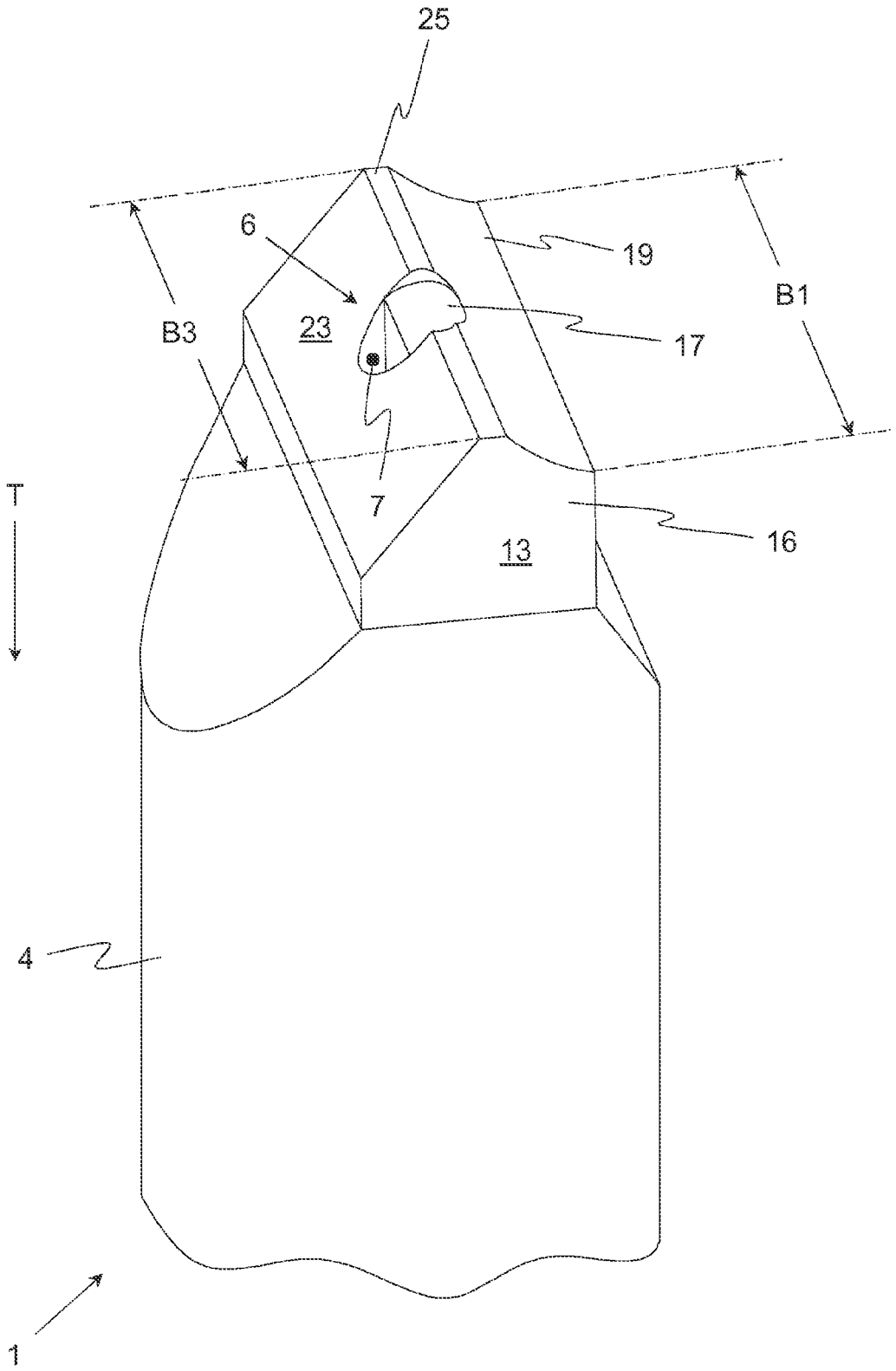
FIG. 5 shows a perspective view of part of a spinning nozzle according to the invention.
Figure 9:
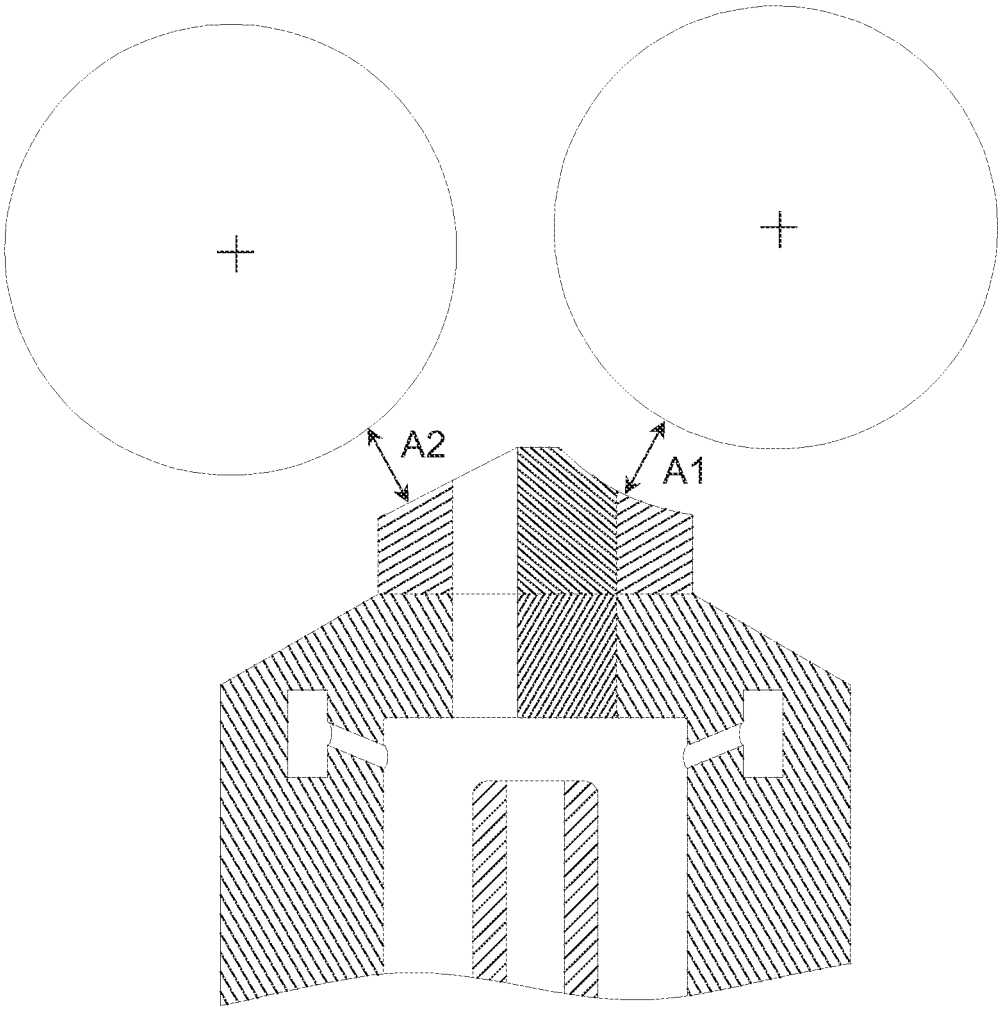
FIG. 9 shows the view according to FIG. 4 with changed position of the first and second roller.
Figure 10:
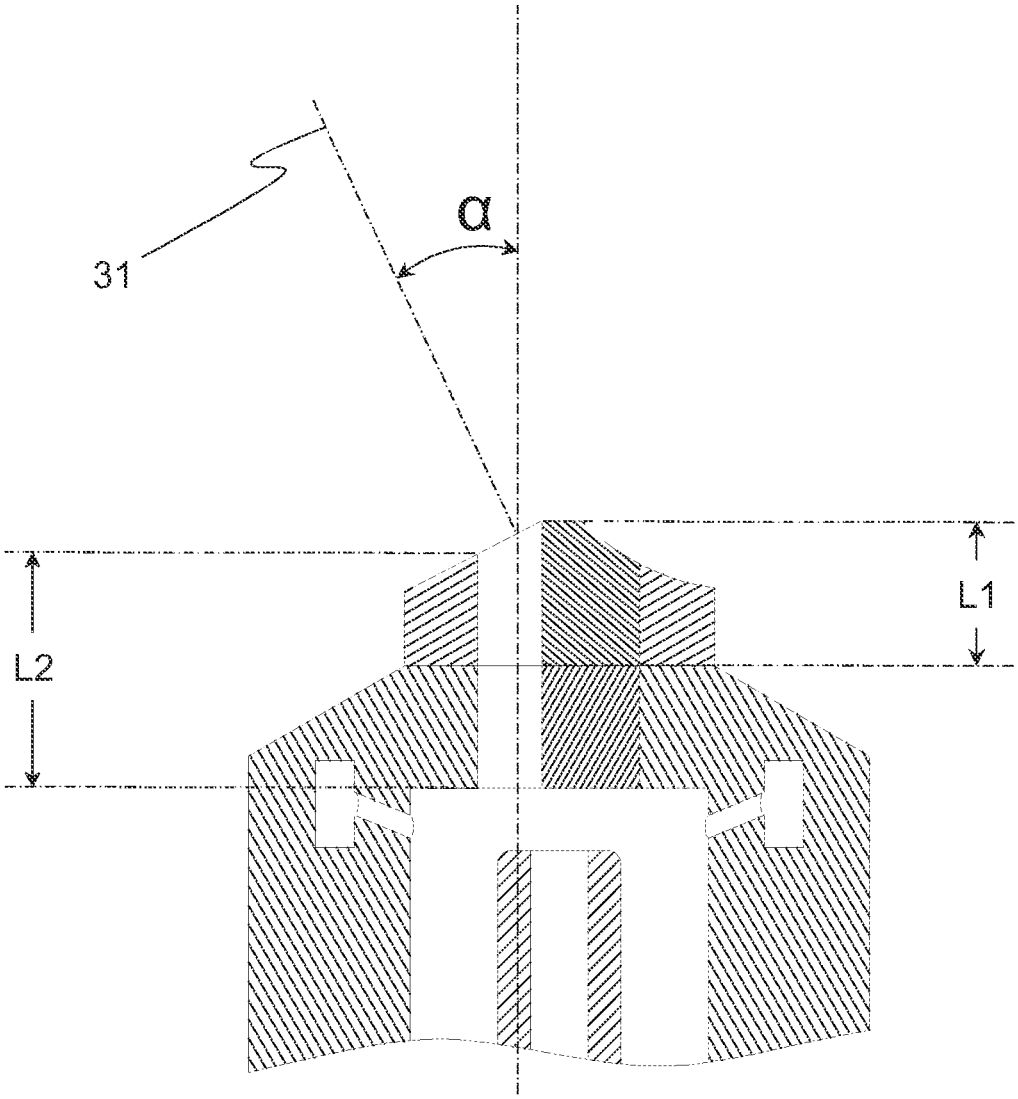
FIG. 10 shows the view according to FIG. 4 without delivery roller pair.

Furthermore, advantageous dimensions are identified in FIGS. 5, 9 and 10, wherein, with regard to the reference symbols in FIGS. 9 and 10, reference is made to FIG. 3 that shows the identical section of the spinning station 26 according to the invention as in FIGS. 9 and 10 (wherein the first roller 22 and the second roller 24 in FIG. 9 have been displaced somewhat from the extension piece 13 merely in order to make the two distances A1 and A1 easier to identify).

With regard to the values of the distances identified and the angle $\alpha$, reference is made to the previous description and to the corresponding claims, wherein the respective reference symbols are based on the following definitions:

$\alpha$ Angle between the normal 31 of the flat region of the second surface section 23 and the longitudinal axis of the fiber guide channel 7 which extends in the transport direction A1 Distance between the first roller 22 and the concave surface section 19 of the extension piece 13

A2 Distance between the second roller 24 and the second surface section 23 of the extension piece 13

L1 Length of the insert 17

L2 Length of the guide channel

B1 Width of the concave surface section 19 of the extension piece 13 running perpendicular to the transport direction B2 Width of the sleeve surface 21 of the first roller 22

B3 Width of the intermediate section of the extension piece 13 running perpendicular to the transport direction.

Figure 11:
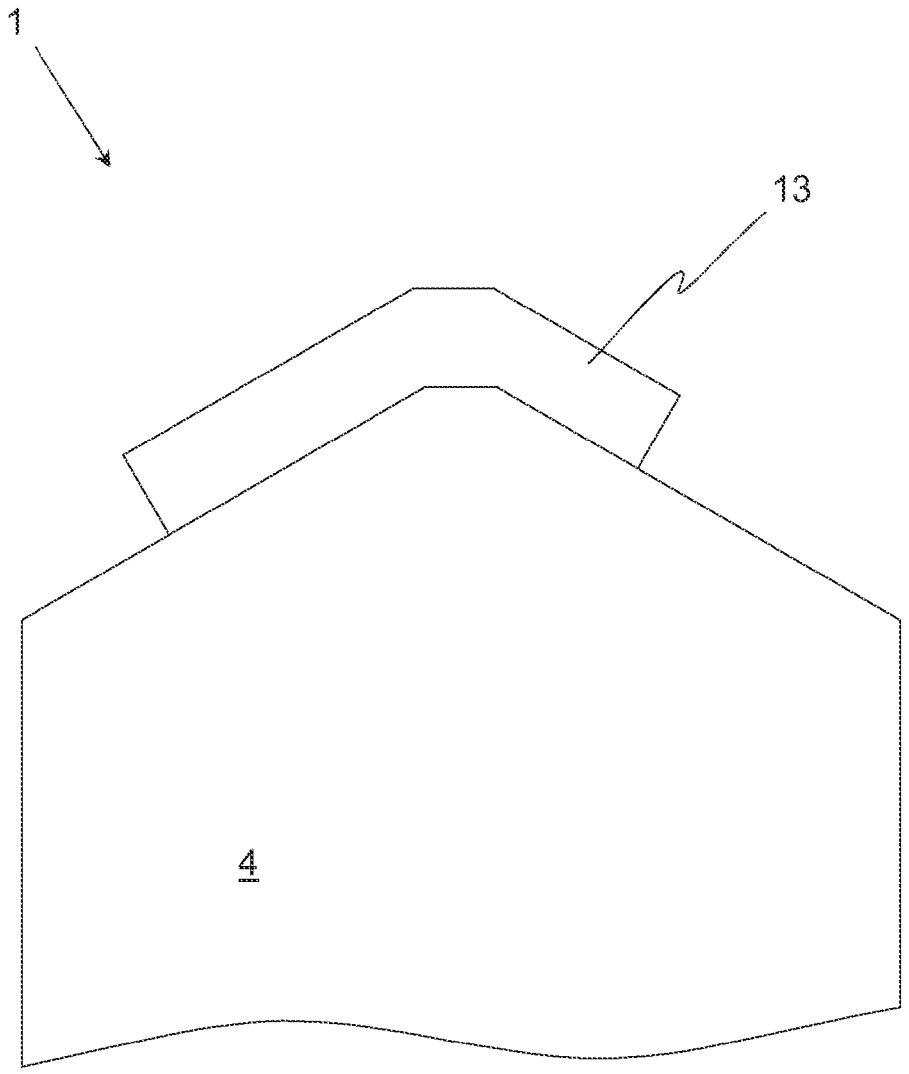
FIG. 11 shows a section of a spinning nozzle according to the invention in a side view.

Finally, FIG. 11 shows a section of a spinning nozzle 1 according to the invention in a side view, from which a further advantageous development of the present invention can be seen. It would be conceivable to design the base body 4 of the spinning nozzle 1 and the extension piece 13 in such a way that they rest against one another in an interlocking manner. Here, the mutually touching surfaces of base body 4 and extension piece 13 can be flat or level (in this case, the surface of the said surfaces would run perpendicular to the plane of the page, i.e. parallel to the axis of rotation of the first roller 22). Particularly in this case, it would additionally be advantageous to design the mutually touching surfaces in such a way that a displacement of base body 4 and extension piece 13 with respect to one another in a direction running perpendicular to the plane of the page can be prevented. For example, this could be achieved by a surface design of the said elements that ensures the necessary frictional contact or a corresponding interlocking between base body 4 and extension piece 13.

Likewise, the magnets 15 already mentioned, which also ensure a certain positional stability of the extension piece 13 with respect to the base body 4, can also be used.

It is likewise conceivable to design the surface of the base body 4 that rests against the extension piece 13 in the form of a cone or truncated cone, wherein the surface of the extension piece 13 that rests on this surface would likewise have to be designed to follow the surface of a cone or truncated cone.

Finally, it is pointed out that the characteristics described in conjunction with FIG. 11 can also be combined with one or more of the characteristics previously described (e.g. the characteristic of the concave surface section 19).

The present invention is not restricted to the exemplary embodiments shown and described. Variations within the framework of the patent claims are possible as well as a combination of the characteristics, even when they are shown and described in different exemplary embodiments.

The invention claimed is:

1. A spinning nozzle for an air-jet spinning machine that produces a thread from a fiber sliver, comprising:

a base body with an internal turbulence chamber;

an inlet opening through which the fiber sliver enters the turbulence chamber in a transport direction of the fiber sliver through the air-jet spinning machine;

a fiber guide channel disposed between the inlet opening and the turbulence chamber to guide the fiber sliver entering the inlet opening;

a thread-forming element disposed at least partially into the turbulence chamber and having an inlet mouth and a take-off channel for the thread in the transport direction;

air nozzles directed so as to open into the turbulence chamber in the region of a wall that encompasses the turbulence chamber; and an extension piece formed separate from and releasably attached to the base body in the region of the inlet opening, the fiber guide channel formed at least partially by a channel section of the extension piece.

2. The spinning nozzle as in claim 1, wherein fiber guide further comprises a channel section formed in the base body that adjoins the channel section in the extension piece.

3. The spinning nozzle as in claim 1, wherein the extension piece is engaged on the base body in one of an interlocking connection or a frictional connection that counteracts movement of the extension piece relative to the base body.

4. The spinning nozzle as in claim 1, wherein the extension piece comprises a base element and an insert configured within the base element, wherein the insert is in contact with a fiber guide element within the base body, and wherein the insert and the fiber guide element jointly define at least a portion of the fiber guide channel.

5. The spinning nozzle as in claim 1, wherein the extension piece comprises a concave surface section extending perpendicular to the transport direction and aligned to follow a contour of a cylindrical sleeve adjacent the extension piece.

6. The spinning nozzle as in claim 5, wherein the insert has a length (L1) extending in the transport direction between 1 mm and 100 mm.

7. The spinning nozzle as in claim 6, the fiber guide channel has a length (L2) extending in the transport direction between 6 mm and 110 mm.

8. A spinning station of an air-jet spinning machine, wherein the spinning station comprises a spinning nozzle as set forth in claim 1, and further comprising a delivery roller pair disposed before the spinning nozzle in the transport direction.

9. The spinning station as in claim 8, wherein the extension piece has a concave surface section extending perpendicular to the transport direction adjacent to a sleeve surface of a first roller of the delivery roller pair, and wherein the concave surface section and the sleeve surface are concentric.

10. The spinning station as in claim 9, wherein the concave surface section has a width (B1) in a direction perpendicular to the transport direction, the sleeve surface of the first roller has a width (B2), and wherein a ratio between (B1) and (B2) lies between 0.2 and 5.

11. The spinning station as in claim 10, wherein the extension piece has a flat second surface section adjacent to the concave surface section, the second surface section adjacent to a sleeve surface of a second roller of the delivery roller.

12. The spinning station as in claim 11, wherein a normal to the second surface section defies an angle $\alpha$ with a longitudinal axis of the fiber guide channel extending in the transport direction between 0° and 60°.

13. The spinning station as in claim 11, wherein a gap with distance A1 is defined between the first roller and the concave surface section, and a gap with distance (A2) is defined between the second roller and the second surface section, wherein the distance (A1) is less than the distance (A2).

14. The spinning station as in claim 13, wherein the distance (A1) is between 0.1 mm and 5 mm, and the distance (A2) is between 0.5 mm and 10 mm.

15. The spinning station as in claim 11, wherein the concave surface section and the second surface section are joined by an intermediate surface having a width (B3) running perpendicular to the transport direction, wherein a ratio between (B2) and (B3) is between 0.2 and 5, and the intermediate surface has a height (H) running perpendicular to the transport direction and perpendicular to the width (B3) between 0 mm and 12 mm.

* * * * *